US008246164B2

(12) United States Patent
Mealy et al.

(10) Patent No.: US 8,246,164 B2
(45) Date of Patent: Aug. 21, 2012

(54) HANDHELD MOBILE PRINTING DEVICE CAPABLE OF REAL-TIME IN-LINE TAGGING OF PRINT SURFACES

(75) Inventors: James Mealy, Corvallis, OR (US); James D. Bledsoe, Corvallis, OR (US)

(73) Assignee: Marvell World Trade Ltd., St. Michael (BB)

( * ) Notice: Subject to any disclaimer, the term of this patent is extended or adjusted under 35 U.S.C. 154(b) by 454 days.

(21) Appl. No.: 12/398,085

(22) Filed: Mar. 4, 2009

(65) Prior Publication Data

US 2009/0237482 A1 Sep. 24, 2009

Related U.S. Application Data

(60) Provisional application No. 61/037,552, filed on Mar. 18, 2008.

(51) Int. Cl.
*B41J 29/13* (2006.01)

(52) U.S. Cl. ..... 347/109; 347/108

(58) Field of Classification Search ..... 347/109, 347/108, 101, 1, 2, 5, 19; 400/88
See application file for complete search history.

(56) References Cited

U.S. PATENT DOCUMENTS

| | | | | |
|---|---|---|---|---|
| 5,927,872 | A | 7/1999 | Yamada | |
| 6,846,119 | B2 * | 1/2005 | Walling | 347/109 |
| 2003/0043388 | A1 | 3/2003 | Andrews et al. | |
| 2005/0018033 | A1 | 1/2005 | Walling | |
| 2006/0250469 | A1 | 11/2006 | Silverbrook et al. | |
| 2007/0263062 | A1 * | 11/2007 | Noe et al. | 347/109 |
| 2008/0145126 | A1 * | 6/2008 | Levy | 400/76 |
| 2009/0040286 | A1 * | 2/2009 | Tan et al. | 347/109 |

FOREIGN PATENT DOCUMENTS

| | | | |
|---|---|---|---|
| EP | 1259058 | A2 | 11/2002 |
| JP | 2003500250 | A | 1/2003 |
| JP | 200348343 | A | 2/2003 |
| WO | WO00/72129 | A1 | 11/2000 |
| WO | WO 03/006249 | A1 | 1/2003 |

* cited by examiner

*Primary Examiner* — Manish S Shah

(57) ABSTRACT

Embodiments of the present invention provide a method that includes moving a handheld device over a print medium, depositing a tagging substance with the handheld device in a tagging pattern on the print medium, further moving the handheld device over the print medium such that at least one sensor of the handheld device senses at least part of the tagging pattern, and determining at least one of a position and/or a velocity of the handheld device based upon the sensing at least part of the tagging pattern. The tagging pattern is configured to provide absolute position information.

18 Claims, 10 Drawing Sheets

Regions for
ArcTan Ratio

HANDHELD MOBILE PRINTING DEVICE CAPABLE OF REAL-TIME IN-LINE TAGGING OF PRINT SURFACES

CROSS REFERENCE TO RELATED APPLICATIONS

The present application claims priority to U.S. Patent Application No. 61/037,552, filed Mar. 18, 2008, entitled "Handheld Mobile Printing Using Real-Time In-Line Tagging," the entire specification of which is hereby incorporated by reference in its entirety for all purposes, except for those sections, if any, that are inconsistent with this specification.

TECHNICAL FIELD

Embodiments of the present invention relate to the field of image translation and, more particularly, to determining positioning of a handheld image translation device.

BACKGROUND

Traditional printing devices rely on a mechanically operated carriage to transport a print head in a linear direction as other mechanics advance a medium in an orthogonal direction. As the print head moves over the medium an image may be laid down. Portable printers have been developed through technologies that reduce the size of the operating mechanics. However, the principles of providing relative movement between the print head and medium remain the same as traditional printing devices. Accordingly, these mechanics limit the reduction of size of the printer as well as the material that may be used as the medium.

Handheld printing devices have been developed that ostensibly allow an operator to manipulate a handheld device over a medium in order to print an image onto the medium. However, these devices are challenged by the unpredictable and nonlinear movement of the device by the operator. The variations of operator movement, including rotation of the device itself, make it difficult to determine the precise location of the print head. This type of positioning error may have deleterious effects of the quality on the printed image.

One navigation solution for a handheld mobile printer uses 1 or 2 navigation sensors (such as optical mouse sensors) that have position accuracy errors related to the accuracy of the sensor and the inherent sensor error associated with the distance travelled during the printing process. Secondarily, the printing device can not be lifted from the print medium without losing position information, and can not reacquire absolute position information when returned to the print medium. This navigation solution uses optical or laser navigation sensors with plain or unmarked paper. These navigation sensors determine X, Y position data relative to the actual motion that is taking place on the print medium. They often have a high degree of accuracy for small amount of motion (travel), but position errors generally accumulate over larger motion (such as is required to produce a printed image). These position errors can not be filtered out or reset. Position errors become cumulative over time. As part of the position determination process, this solution also requires a configuration of two sensors that each provide absolute X, Y position data that is then used to calculate the required angular accuracy for the print head position that is required to support printing.

A second handheld mobile printer navigation solution uses pre-tagged paper, which has many advantages that can contribute desirable qualities of Print Quality (PQ) such as absolute position information that can be encoded on the paper, therefore eliminating cumulative position errors and allowing the handheld printer to be lifted from the paper, which provides improved user friendly flexibility. This second solution for the handheld mobile printer uses pre-marked (pre-tagged) paper using a marking technology that is not visible to the human eye such as yellow or infrared on the paper medium. This pre-tagged media/paper has encoded on its surface accurate absolute X, Y position information relative to the actual position that the data was encoded on the media. To decode or determine the position data, this solution uses different sensors that can read the encoded information to extract the absolute X, Y position data. The solution uses "CMOS imaging sensors" (IR Cameras) tuned to the light wave of the encoded marking that then can read the absolute encoded X, Y position information on the media while the handheld printer is in motion. The solution allows the handheld printer to extract absolute position for each position measurement. Position errors are not cumulative. As with the optical navigation (mouse sensors) technology, this solution again requires a configuration using two sensors that each provides absolute X, Y position data that is then used to calculate the required angular accuracy for the print head position that is required to support printing.

SUMMARY

The present invention provides a method that includes moving a handheld device over a print medium, depositing a tagging substance with the handheld device in a tagging pattern on the print medium, further moving the handheld device over the print medium such that at least one sensor of the handheld device senses at least part of the tagging pattern, and determining at least one of a position and/or a velocity of the handheld device based upon the sensing at least part of the tagging pattern.

In accordance with various embodiments, the method further includes depositing more of the tagging substance while further moving the handheld device.

In accordance with various embodiments, the method further includes depositing a printing substance on the print medium while further moving the handheld device.

In accordance with some embodiments, the method includes using an image representation to determine a level of deposition of the printing substance.

In accordance with various embodiments, the method further includes using the image representation to determine a level of deposition of the printing substance.

In accordance with some embodiments, the method includes using in a major representation that is modified as the printing substance is deposited.

In accordance with various embodiments, the method further includes determining a predictive position of the handheld device.

In accordance with some embodiments, the predictive position is determined using a two-dimensional parametric curve function. In accordance with some embodiments, the two-dimensional parametric curve function is a Catmull-Rom Bicubic Spline function.

The present invention also provides a handheld device that includes a print head configured to deposit a tagging substance that indicates absolute position information for the handheld device, a print module configured to control the print head, and a position module comprising at least one image sensor and configured to determine at least one of a position and/or velocity of the handheld device based upon the at least one sensor reading the tagging substance located on a surface adjacent to the device.

The present invention also provides an article of manufacture that comprises a storage medium and a set of instructions stored in the storage medium which, when executed by an apparatus, causes the apparatus to perform operations comprising depositing a tagging substance with a handheld device in a tagging pattern on a print medium while the handheld device is moved over a print medium, sensing at least part of the tagging pattern with at least one sensor of the handheld device while the handheld device is further moved over the print medium, and determining at least one of a position and/or a velocity of the handheld device based upon the sensing at least part of tagging pattern.

BRIEF DESCRIPTION OF THE DRAWINGS

Embodiments of the present invention will be readily understood by the following detailed description in conjunction with the accompanying drawings. To facilitate this description, like reference numerals designate like structural elements. Embodiments of the invention are illustrated by way of example and not by way of limitation in the figures of the accompanying drawings.

DETAILED DESCRIPTION OF EMBODIMENTS OF THE INVENTION

In the following detailed description, reference is made to the accompanying drawings which form a part hereof wherein like numerals designate like parts throughout, and in which is shown by way of illustration embodiments in which the invention may be practiced. It is to be understood that other embodiments may be utilized and structural or logical changes may be made without departing from the scope of the present invention. Therefore, the following detailed description is not to be taken in a limiting sense, and the scope of embodiments in accordance with the present invention is defined by the appended claims and their equivalents.

Various operations may be described as multiple discrete operations in turn, in a manner that may be helpful in understanding embodiments of the present invention; however, the order of description should not be construed to imply that these operations are order dependent.

The description may use perspective-based descriptions such as up/down, back/front, and top/bottom. Such descriptions are merely used to facilitate the discussion and are not intended to restrict the application of embodiments of the present invention.

For the purposes of the present invention, the phrase "A/B" means A or B. For the purposes of the present invention, the phrase "A and/or B" means "(A), (B), or (A and B)." For the purposes of the present invention, the phrase "at least one of A, B, and C" means "(A), (B), (C), (A and B), (A and C), (B and C), or (A, B and C)." For the purposes of the present invention, the phrase "(A)B" means "(B) or (AB)" that is, A is an optional element.

The description may use the phrases "in an embodiment," or "in embodiments," which may each refer to one or more of the same or different embodiments. Furthermore, the terms "comprising," "including," "having," and the like, as used with respect to embodiments of the present invention, are synonymous.

Figure 1:
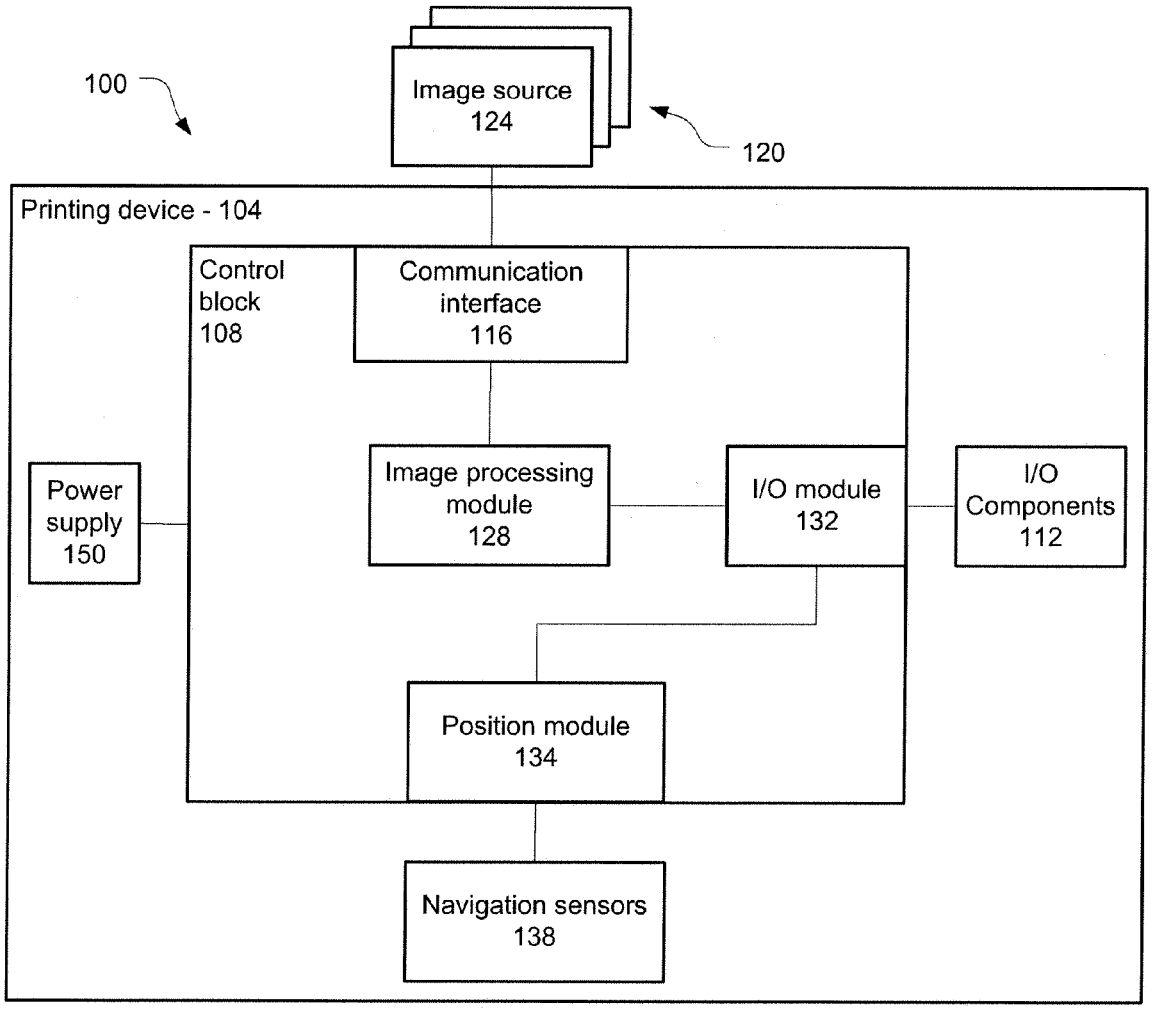
FIG. 1 is a schematic of a system including a handheld image translation device, in accordance with various embodiments of the present invention.

FIG. 1 is a schematic of a system 100 including a handheld image translation (IT) device 104 in accordance with various embodiments of the present invention. The IT device 104 may include a control block 108 with components designed to facilitate precise and accurate positioning of input/output (I/O) components 112 throughout an entire IT operation. This positioning may allow the IT device 104 to reliably translate an image in a truly mobile and versatile platform as will be explained herein.

Image translation, as used herein, may refer to a translation of an image that exists in a particular context (e.g., medium) into an image in another context. For example, an IT operation may be a scan operation. In this situation, a target image, e.g., an image that exists on a tangible medium, is scanned by the IT device 104 and an acquired image that corresponds to the target image is created and stored in memory of the IT device 104. For another example, an IT operation may be a print operation. In this situation, an acquired image, e.g., an image as it exists in memory of the IT device 104, may be printed onto a medium.

The control block 108 may include a communication interface 116 configured to communicatively couple the control block 108 to an image transfer device 120. The image transfer device 120 may include any type of device capable of transmitting/receiving data related to an image, or image data, involved in an IT operation. The image transfer device 120 may include a general purpose computing device, e.g., a desktop computing device, a laptop computing device, a mobile computing device, a personal digital assistant, a cellular phone, etc. or it may be a removable storage device, e.g., a flash memory data storage device, designed to store data such as image data. If the image transfer device 120 is a removable storage device, e.g., a universal serial bus (USB) storage device, the communication interface 116 may be coupled to a port, e.g., USB port, of the IT device 104 designed to receive the storage device.

The communication interface 116 may include a wireless transceiver to allow the communicative coupling with the image transfer device 120 to take place over a wireless link. The image data may be wirelessly transmitted over the link through the modulation of electromagnetic waves with frequencies in the radio, infrared or microwave spectrums.

A wireless link may contribute to the mobility and versatility of the IT device 104. However, some embodiments may additionally/alternatively include a wired link communicatively coupling the image transfer device 120 to the communication interface 116.

In some embodiments, the communication interface 116 may communicate with the image transfer device 120 through one or more wired and/or wireless networks including, but not limited to, personal area networks, local area networks, wide area networks, metropolitan area networks, etc. The data transmission may be done in a manner compatible with any of a number of standards and/or specifications including, but not limited to, 802.11, 802.16, Bluetooth, Global System for Mobile Communications (GSM), code-division multiple access (CDMA), Ethernet, etc.

When the IT operation includes a print operation, the communication interface 116 may receive image data from the image transfer device 120 and transmit the received image data to an on-board image processing module 128. The image processing module 128 may process the received image data in a manner to facilitate an upcoming printing process. Image processing techniques may include dithering, decompression, half-toning, color plane separation, and/or image storage. In various embodiments some or all of these image processing operations may be performed by the image transfer device 120 or another device. The processed image may then be transmitted to an I/O module 132, which may function as a print module in this embodiment, where it is cached in anticipation of the print operation.

The I/O module 132, which may be configured to control the I/O components 112, may receive positioning information indicative of a position of a print head of the I/O components 112 relative to a reference location from a position module 134. The position module 134 may control one or more navigation sensors 138 to capture navigational measurements to track incremental movement of the IT device 104 relative to the reference location.

In some embodiments, the navigational measurements may be navigational images of a medium adjacent to the IT device 104. In these embodiments, the navigation sensors 138 may include one or more imaging navigation sensors. An imaging navigation sensor may include a light source, e.g., light-emitting diode (LED), a laser, etc., and an optoelectronic sensor designed to capture a series of navigational images of an adjacent medium as the IT device 104 is moved over the medium. In accordance with various embodiments of the present invention, the navigation sensors 138 comprise infrared complementary metal oxide semiconductor (IR CMOS) sensors, also known in the art as IR Cameras.

The position module 134 may process the navigational images to detect structural variations of the medium. The movement of the structural variations in successive images may indicate motion of the IT device 104 relative to the medium. Tracking this relative movement may facilitate determination of the precise positioning of the navigation sensors 138. The navigation sensors 138 may be maintained in a structurally rigid relationship with the I/O components 112, thereby allowing for calculation of the precise location of the I/O components 112.

The navigation sensors 138 may have operating characteristics sufficient to track movement of the IT device 104 with the desired degree of precision. In one example, imaging navigation sensors may process approximately 2000 frames per second, with each frame including a rectangular array of 30×30 pixels. Each pixel may detect a six-bit grayscale value, e.g., capable of sensing 64 different levels of patterning.

Once the I/O module 132 receives the positioning information it may coordinate the location of the print head to a portion of the processed image with a corresponding location. The I/O module 132 may then control the print head of the I/O components 112 in a manner to deposit a printing substance on the medium adjacent to the IT device 104 to represent the corresponding portion of the processed image.

The print head may be an inkjet print head having a plurality of nozzles designed to emit liquid ink droplets. The ink, which may be contained in reservoirs or cartridges, may be black and/or any of a number of various colors. A common, full-color inkjet print head may have nozzles for cyan, magenta, yellow, and black ink. Other embodiments may utilize other printing techniques, e.g., toner-based printers such as laser or LED printers, solid ink printers, dye-sublimation printers, inkless printers, etc.

In an embodiment in which an IT operation includes a scanning operation, the I/O module 132 may function as an image capture module and may be communicatively coupled to one or more optical imaging sensors of the I/O components 112. Optical imaging sensors, which may include a number of individual sensor elements, may be designed to capture a plurality of surface images of a medium adjacent to the IT device 104. The surface images may be individually referred to as component surface images. The I/O module 132 may generate a composite image by stitching together the component surface images. The I/O module 132 may receive positioning information from the position module 134 to facilitate the arrangement of the component surface images into the composite image.

Relative to the imaging navigation sensors, the optical imaging sensors may have a higher resolution, smaller pixel size, and/or higher light requirements. While the imaging navigation sensors are configured to capture details about the structure of the underlying medium, the optical imaging sensors may be configured to capture an image of the surface of the medium itself.

In an embodiment in which the IT device 104 is capable of scanning full color images, the optical imaging sensors may have sensor elements designed to scan different colors.

A composite image acquired by the IT device 104 may be subsequently transmitted to the image transfer device 120 by, e.g., e-mail, fax, file transfer protocols, etc. The composite image may be additionally/alternatively stored locally by the IT device 104 for subsequent review, transmittal, printing, etc.

In addition (or as an alternative) to composite image acquisition, an image capture module may be utilized for calibrating the position module 134. In various embodiments, the component surface images (whether individually, some group, or collectively as the composite image) may be compared to the processed print image rendered by the image processing module 128 to correct for accumulated positioning errors and/or to reorient the position module 134 in the event the position module 134 loses track of its reference point. This may occur, for example, if the IT device 104 is removed from the medium during an IT operation.

The IT device 104 may include a power supply 150 coupled to the control block 108. The power supply 150 may be a mobile power supply, e.g., a battery, a rechargeable battery, a solar power source, etc. In other embodiments the power supply 150 may additionally/alternatively regulate power provided by another component (e.g., the image transfer device 120, a power cord coupled to an alternating current (AC) outlet, etc.).

Figure 2:
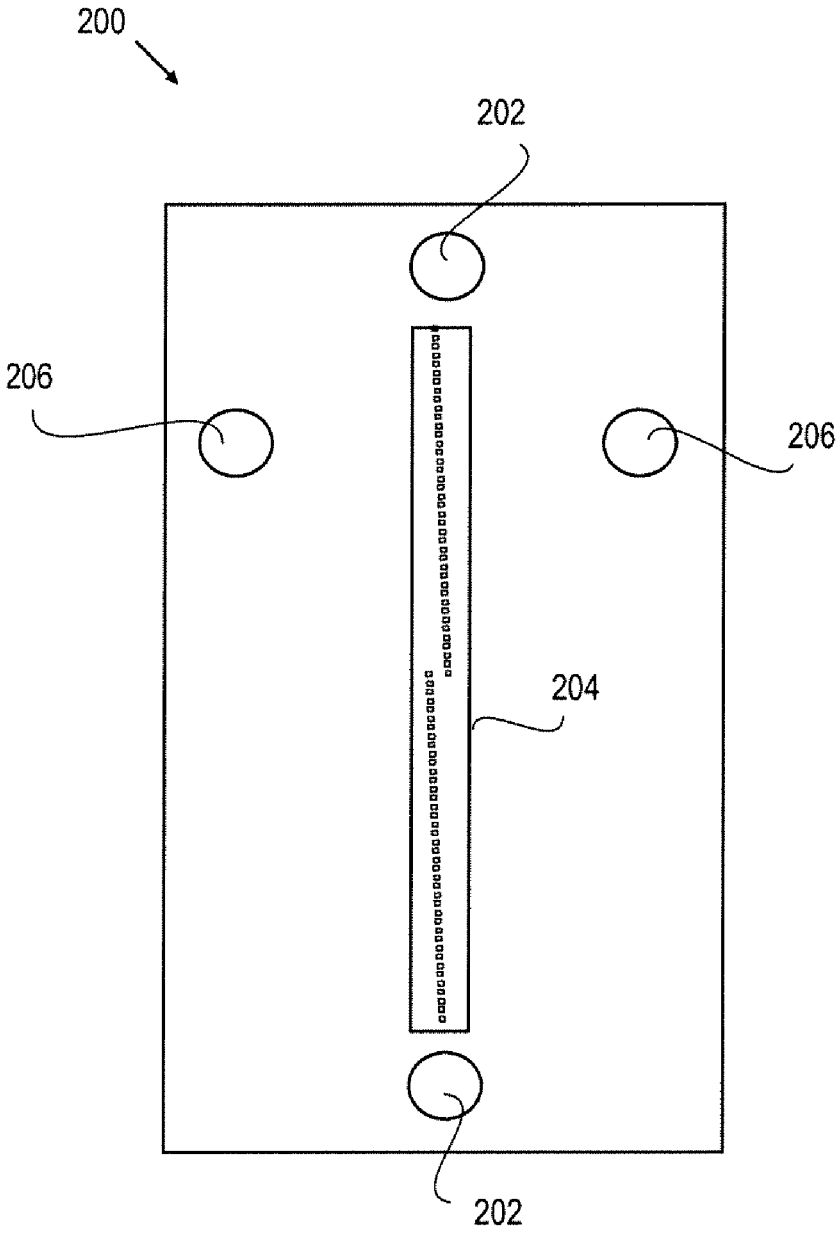
FIG. 2 is a bottom plan view of a handheld image translation device, in accordance with various embodiments of the present invention.

FIG. 2 is a schematic bottom plan view of an example of an IT device 200, which may be interchangeable with IT device 104, configured for inline tagging on untagged print medium, for example, paper. Optical "Mouse" sensors 202 are provided and are generally high quality optical correlation devices that track incremental movement on the medium by correlating images of the surface irregularities on the medium.

Figure 3:
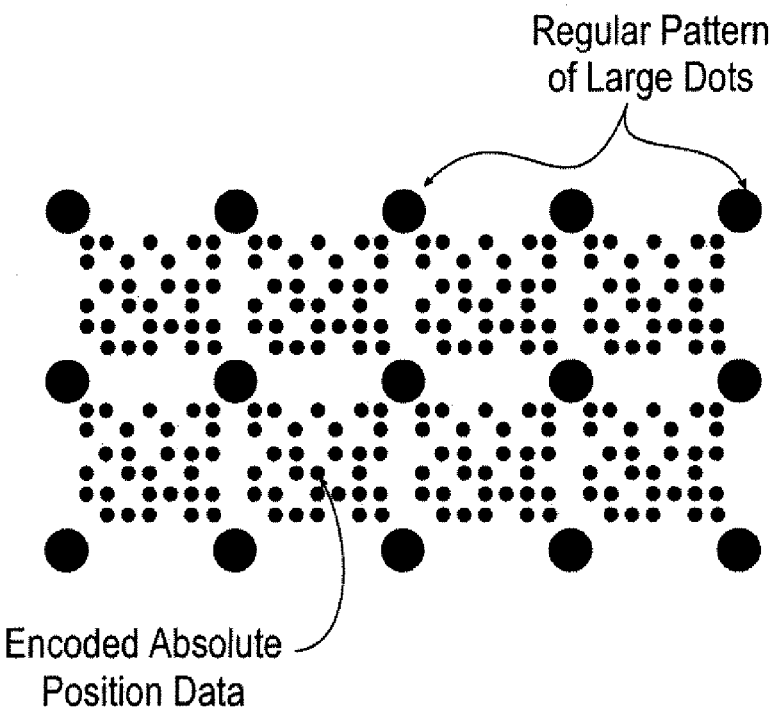
FIG. 3 schematically illustrates an example of an IR tag pattern, in accordance with various embodiments of the present invention.

A print head 204 is capable of printing a wide swath in the vertical axis of the IT device 200. The print head 204 may be an inkjet print head having a number of nozzles and/or nozzle rows for different colored inks. In addition to printing the typical visible pigments that include the Cyan, Magenta, Yellow and Black (CMYK) inks typically used for digital printing, it can also print special inks that are only visible under infra-red (IR) illumination. The IR ink is deposited on the paper in a pattern that can be recognized by IR tag sensors 206 (e.g., IR CMOS sensors). Embedded in the pattern is absolute position information that is unique to each image cell. FIG. 3 illustrates an example of a pattern. The IR tag sensors 206 may be used by a position module, e.g., position module 134, to determine positioning information related to the print head 204, as will be more fully described herein.

Figure 4:
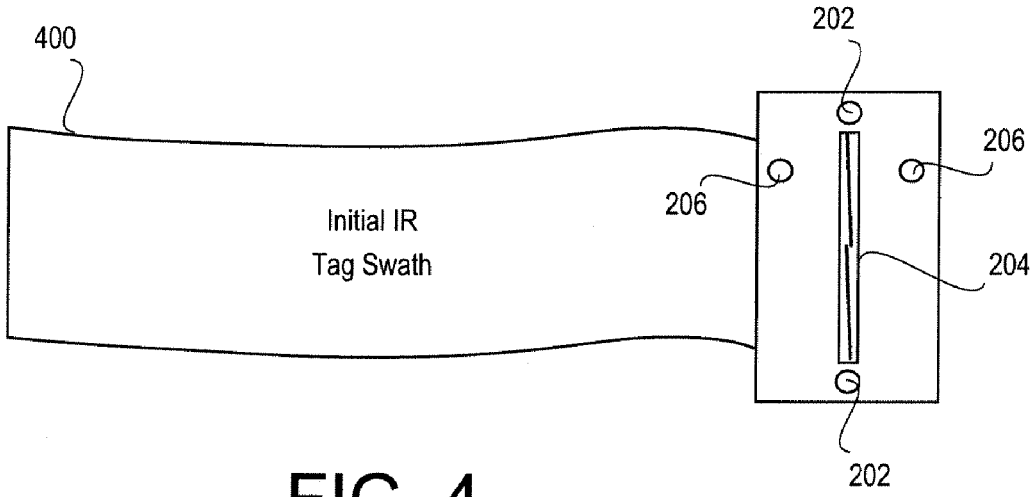
FIG. 4 is a schematic illustration of a handheld image translation of making an initial IR swath, in accordance with various embodiments of the present invention.

Typically the handheld IT device 200 is scanned horizontally across the paper in a zigzag pattern. In order to create the initial IR tag information and calibrate the geometry of the tagged pattern, the IT device 200 is scanned across an area that covers the width of the print job in an initial tag swath 400, as may be seen in FIG. 4.

The initial IR tag swath 400 serves as a calibration process and may be printed in a single sweep of the IT device 200 over the print medium. During this sweep, the IR tag sensors 206 provide no input into the navigation process. The navigation is handled entirely by the optical sensors 202. Generally, the optical sensors 202 do not provide absolute accuracy and only provide information relative to incremental movement from a previous position.

Position error derived from an optical sensor is generally proportional to the distance travelled. Since the majority of the movement is in the X or horizontal direction, the sensed X data will have larger absolute errors than the sensed Y data. Usually, the Y movement is kept to a minimum such that the absolute Y error is small enough to be ignored. In general, the most objectionable distortion of the tag image will be angular. Although there will be some stretching or compression of the tag image in the horizontal direction, this distortion is generally not as visible to the user.

The goal of the initial IR tag swath 400 is first to compensate for the angular distortion and subsequently the X scaling errors. There may be errors in the Y axis, but this distortion is small and will be generally distributed equally over the entire image. The Y distortion, if exaggerated, would be perceived as a vertical waviness in the initial IR tag swath 400 in FIG. 4.

In accordance with various embodiments of the present invention, the calibration process depends on two known geometries and the assumption that the Y position error is minimal. The first known geometry is the separation of the two IR tag sensors 206. The second known geometry is the vertical axis of the print head 204.

Figure 5:
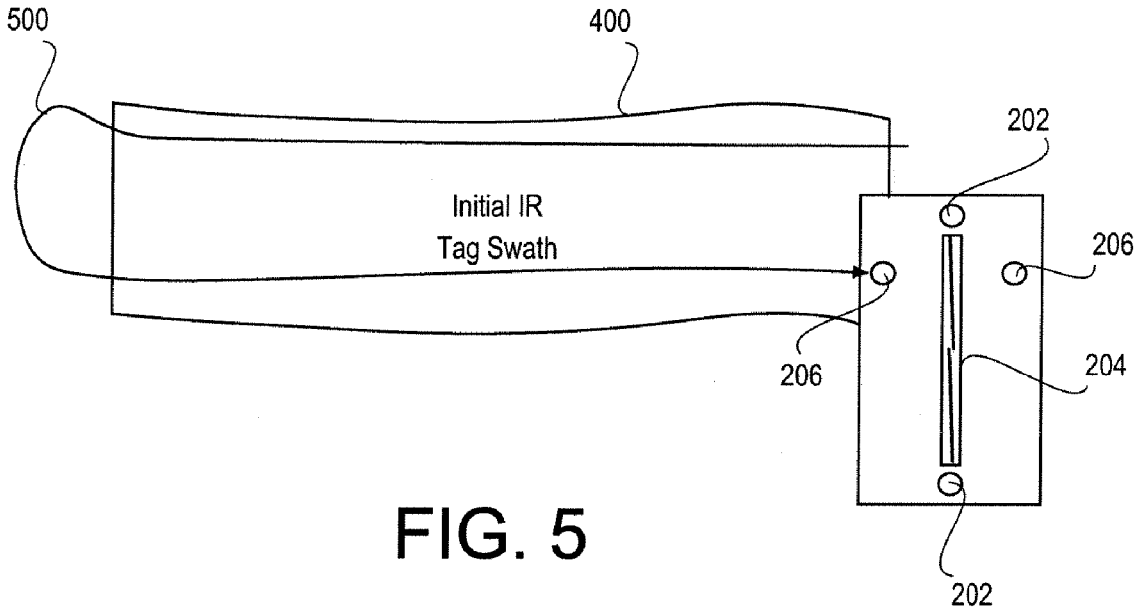
FIG. 5 is a schematic illustration of a handheld image translation of making a calibration sweep of the initial IR swath, in accordance with various embodiments of the present invention.

FIG. 5 illustrates a desired calibration sweep 500 of the IT device 200 over the initial IR tag swath 400. The IR tag sensors 206 are offset to the top of the print head such that they make overlapping with a previous swath as likely as possible. The purpose of the calibration sweep 500 is to sample the initial IR swath 400 as close as possible to the top and the bottom of the swath 400. In order to help guide the user, in accordance with various embodiments, very light visible markers may be printed within the initial IR tag swath 400.

Figure 6:
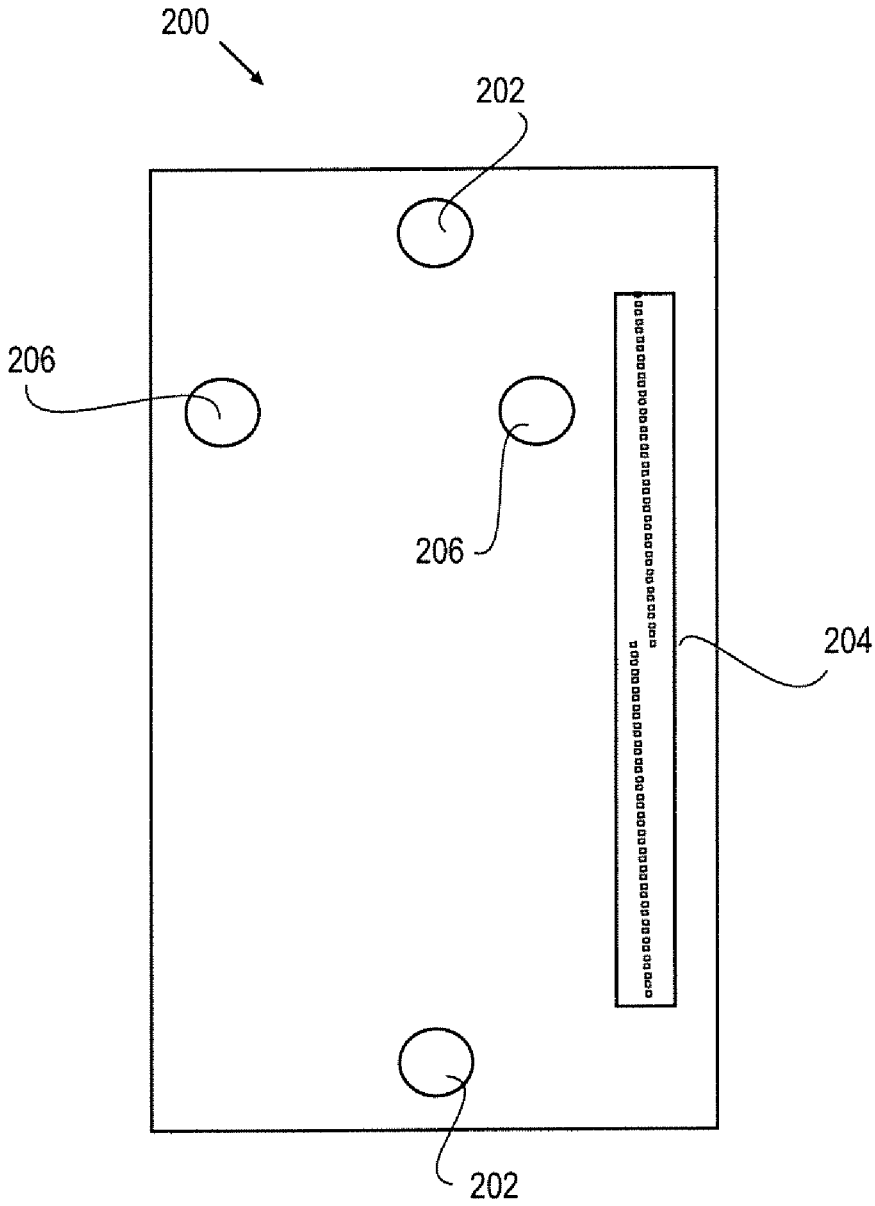
FIG. 6 is a bottom plan view of another example of a handheld image translation device, in accordance with various embodiments of the present invention.

It may be possible to reduce the number of sweeps by having more than one pair of IR tag sensors 206. Another possibility is to put the two IR tag sensors 206 on the left side of the print head as illustrated in FIG. 6. This arrangement would allow one calibration sweep to be incorporated into the initial IR tag swath 400 since the IR tag sensors 206 could read the initial swath 400 immediately as the IR tag swath 400 is being deposited. In any case, the purpose is to allow the system to sample the initial IR tag swath 400 near the top and the bottom of the swath.

Comparing the distance measured by subtracting the left sensor X data from right sensor X data, to the known separation of the two sensors, an accurate map of the X distortion and angular distortion may be created. Since the print head covers the entire vertical width of the swath the vertical relationship of the sample paths are well known. By taking numerous samples along the entire path, a statistically significant measurement with a high degree of confidence may be obtained.

At this point, printing of an image may occur, i.e., a printing substance in the form of, for example, visible ink may be deposited on the print medium. As the printer is moved sequentially along the page, the two IR tag sensors 206 should have sufficient overlap with the previously tagged areas to sense previously deposited tagged information. Using the calibrated initial IR tag swath 400 as an anchor point, subsequent swaths of tag information may be "knitted" into the overall tag pattern.

Figure 7:
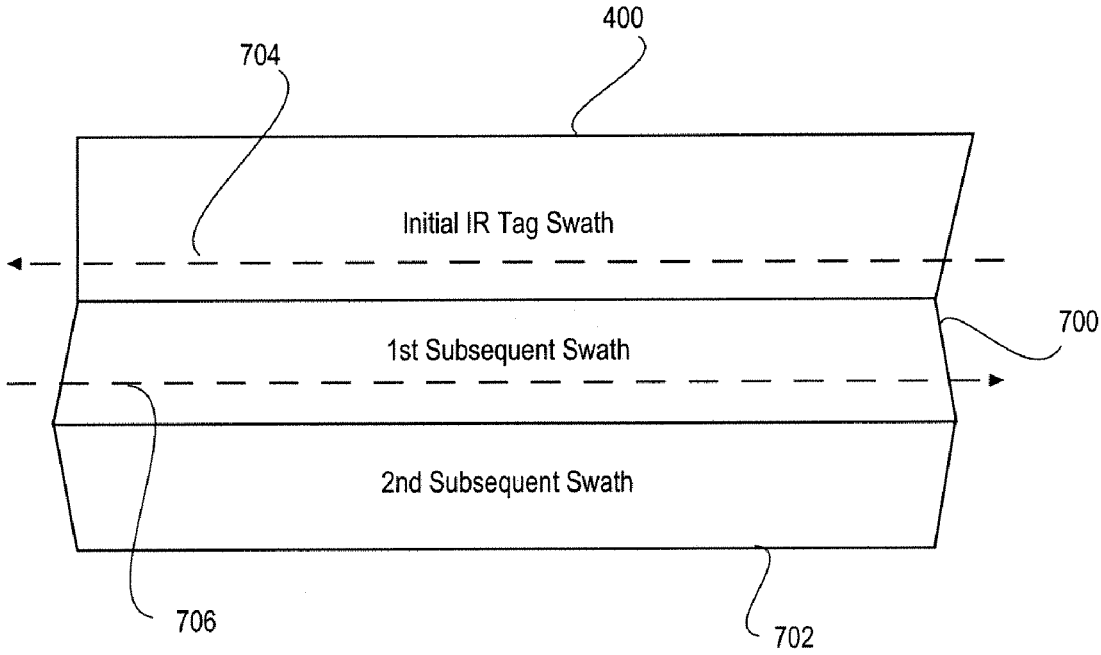
FIG. 7 is a schematic illustration of a handheld image translation of making subsequent IR swaths, in accordance with various embodiments of the present invention.

In order for this knitting of the pattern to occur, the IR tag sensors 206 need to pass over the existing IR pattern. This is necessary for accurate navigation and proper placement of the new IR pattern on subsequent swaths. With reference to FIG. 7, it is apparent that the vertical height of the subsequent swaths 700 and 702 is reduced since there must be some overlap with a previous swath to allow the IR tag sensors 206 to read tag information from the previous swath. This also means that the IR tag sensors 206 should be placed as close as possible to the upper end of the print head 204, insuring good sensor and print head overlap with the previous swath. The paths of the IR tag sensors 206 through the subsequent swaths 700 and 702 are indicated by lines 704 and 706.

As printing progresses, the process of analyzing the existing tag pattern for distortion may continue. Since the swaths that are placed after the initial IR tag swath 400 have the advantage of the IR tag sensor overlap with the previous IR swath, distortion of subsequent swaths may be substantially reduced.

There may be occasions where the printer is inadvertently passed over areas where there is no IR tag information. If the distance travelled since the last valid IR tag is relatively small, the optical sensors 202 may take over navigation for short periods of time. Once the printer has travelled a longer distance or has lost contact with the medium, printing may have to be suspended until contact with the medium has been re-established and valid IR tags may be read.

The optical sensors 202 may also provide intermediate position smoothing. The process of determining absolute position information from the IR tags is complex and currently delivers new data every 10 ms. Although algorithms exist that can do a good job of predicting positions from previous data, they all have potential problems with delay and an inability to react to sudden changes of movement. The optical sensors 202 have the advantage of delivering reasonably accurate movement information over smaller increments of time and distance. So although, the optical sensors 202 cannot provide sufficiently accurate navigation over a large distance, they can provide reliable fast updates of incremental movement between the 10 ms IR sensor updates.

In accordance with various embodiments, the printing process may be delayed, i.e., deposition on the print medium of a printing substance in the form of, for example, visible ink, may be delayed. Thus, the IT device 200 may simply be moved over the print medium to deposit IR tag information on the print medium. For example, the IT device 200 may be used to "pre-tag," for example, sheets of paper that may then be used later for printing. When using the sheets of paper for printing later, the IR tag information may be read by the IR tag sensors 206 to obtain the absolute position information for the printing process. No further deposition of IR tag information will be needed during the printing process.

As previously noted, the IR tag information is comprised of markings or tags encoded on the print medium's surface that provide absolute X, Y position information relative to the actual position that the data was encoded on the medium. To decode or determine the position data, the IR tag sensors 206 are IR CMOS imaging sensors that are able to read the encoded information on the tagged medium in order to extract the absolute X, Y position data. Thus, in accordance with various embodiments, the IR tag sensors 206 are CMOS imaging sensors tuned to the light wave of the encoded markings on the medium that may read the absolute encoded X, Y position information on the medium while the IT device 200 is in motion. This allows the IT device 200 to extract absolute position information for each position measurement. With this type of approach, the position errors are generally not cumulative. In accordance with various embodiments, the IT device 200 includes a configuration using at least two IR tag sensors 206 that each provides the absolute X, Y position data that is then used to calculate the angular accuracy for the print head position that is desired in order to support printing. Additionally, velocity of the IT device 200 may also be determined by calculating the changes in position and the time involved with the changes in position.

Referring back to FIG. 3, the IR signature or tag information may include a regular pattern and a field of digitally encoded data. The regular pattern may be used to determine small scale position offsets and rotation. The data may provide the absolute position on the medium. An example of IR CMOS sensors and tagging technology is provided by Silverbrook research in Sydney, Australia. FIG. 3 illustrates an example of an IR tag pattern. The tags are processed to yield an overall position and angle of each sensor 206. The position information of the two sensors 206 is used to create a composite position and rotation of the IT device 200 printing system. It should be understood that the tags in FIG. 3 are magnified and are actually only millimeters in size. In actual use, the tags are generally printed with ink that absorbs in the IR spectrum and not in the visible spectrum making the markings invisible to the naked eye.

Since the position information delivered by the sensors 206 is absolute with respect to the print medium, very little processing is necessary to determine the final position information. In accordance with various embodiments, the position data from the sensors 206 are scaled to a local form of 16.16 integer data. The 16 bit super radix data is the position in 300th's of an inch to correspond to the resolution of the print system. The two positions are averaged to incorporate the data from both sensors 206 in the final position. Averaging reduces the position noise. The datum of the resultant position is the midpoint between the centers of the two sensors 206. In accordance with various embodiments of the present invention, since the printing system of the IT device 200 desires new position data every millisecond or even faster, intermediate positions may be predicted. A simple first order predictive interpolation may achieve reasonable results. The last two measured positions may be used to compute an X and Y derivative. Interpolated points may be computed by the following equations:

$$Xi=Xs+dx/dt*\Delta T \quad \text{Eq. 1}$$

$$Yi=Ys+dy/dt*\Delta T \quad \text{Eq. 2}$$

In order to deal with changes in velocity and acceleration, a two dimensional parametric curve function may be employed. The two dimensional parametric curve describes the motion of the IT device 200 as a parametric equation with time (t) as the parametric value.

$$X=A_x t^3+B_x t^2+C_x t+D_x$$

$$Y=A_y t^3+B_y t^2+C_y t+D_y \quad \text{Eqs. 3 and 4}$$

Equations 3 and 4 represent the form of a BiCubic Spline, a two dimensional parametric curve. In equations 3 and 4, the coefficients correspond to the starting position (D), velocity (C), acceleration (B), and the rate change of the acceleration (A) in the X and Y axes. There are numerous methods known in the art for determining the coefficients for these equations. One well known method, the Catmull Rom Bicubic Spline, offers the advantage of ensuring that the resulting equations will contain the input control points.

Figure 8:
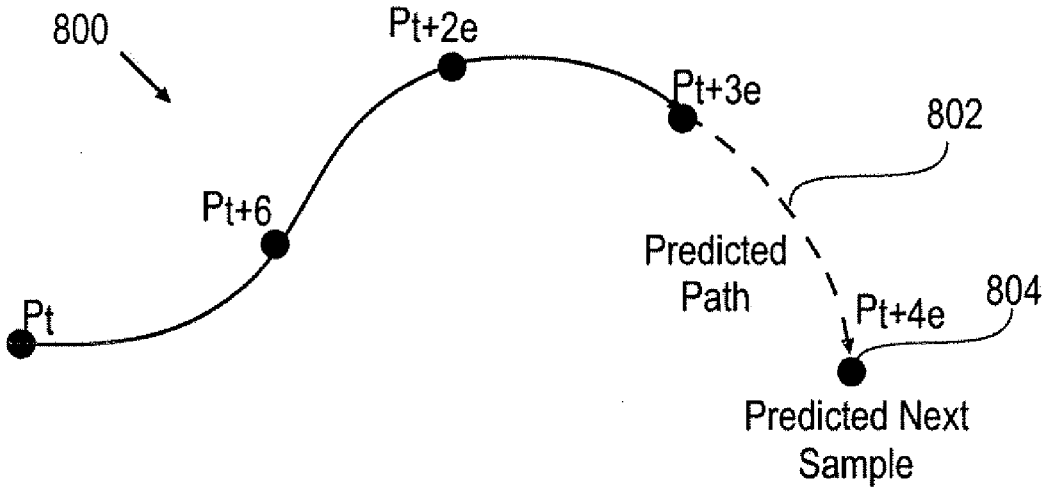
FIG. 8 schematically illustrates an example of a position path.

Referring to FIG. 8, with a 3rd degree equation, four points are generally required to establish all four coefficients for the two equations. The X and Y axes may be treated separately. The sample points may be taken at equal intervals of time. This helps insure that the arc length of the curve is interpreted correctly. If the points on the curve are at widely varying intervals, then the time domain has to be separately smoothed to yield correct prediction results.

Although the Catmull Rom Bicubic Spline coefficients help ensure that the sampled history will be included in the curve 800 defined by the equations, the Predicted Path portion 802 of the curve will not necessarily exactly match the actual path. In order to evaluate the performance of this embodiment, a Predicted Next sample 804 at t+4e may be compared to a next actual position measured by at least one of the sensors 206.

To compute an angle of the IT device 200, the difference in the X and Y positions may be first determined. The X difference is divided by the Y difference. To accomplish this, the values of X and Y may be adjusted to best take advantage of limited 32bit integer arithmetic that may be native to the position module 134.

Figure 9:
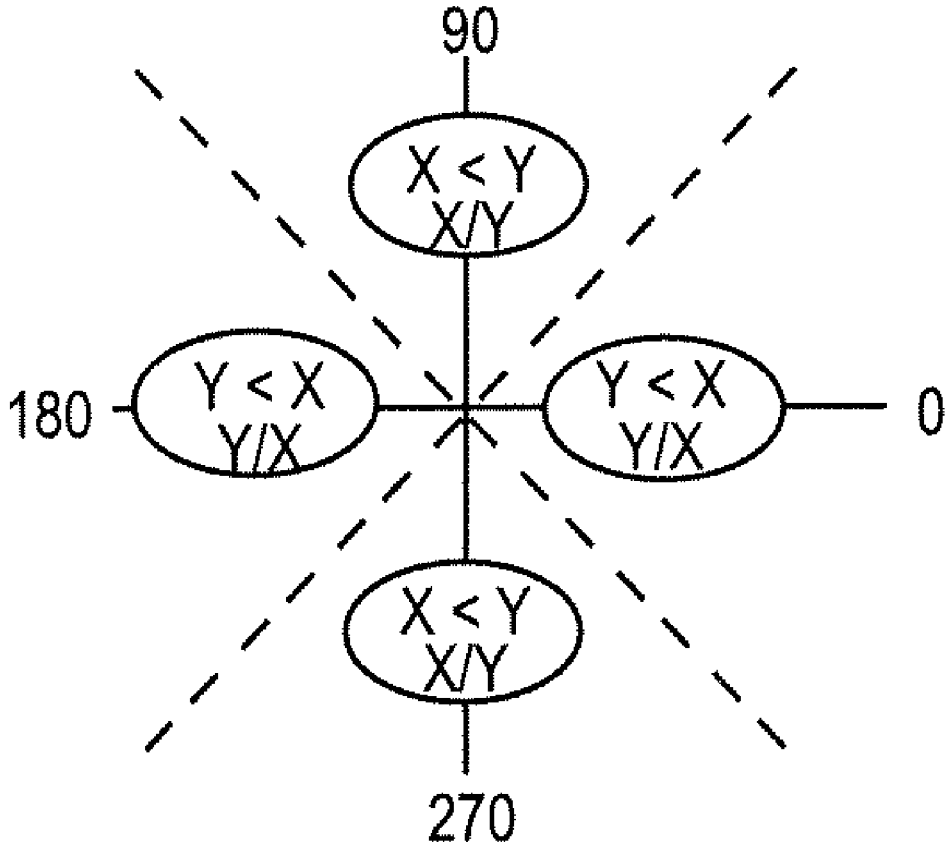
FIG. 9 schematically illustrates regions for Arc Tan ratio.

In accordance with various embodiments, the ratio, X/Y, may be used to determine the Arc Tangent, for example by looking it up in a table. The result of the table lookup is the angle of the IT device 200 with respect to the pre-printed grid of encoded tag information on the print medium. The table may be represented by a range of 0 to 45 degrees in a table that is 16K (K=1024) locations long. The ratio may also be represented as Y/X, when the X value is larger than the Y value. This limits the range of the ratio to numbers that are less than one and avoids the singularity of dividing by zero as the angle approaches 90 degrees and 270 degrees. FIG. 9 illustrates regions for the Arc Tangent ratio.

Using the position and angle information, the position of the IT device 200, and thereby the print head 204, may be determined by the same two dimensional space rotation based on a traditional optical sensor navigation based system.

The result is that the position of the printing of IT device 200 may be fixed to the print medium. To move the starting position of the image on the page, a starting position is captured just before printing starts. This initial position is subtracted from the absolute position, allowing the image to be placed anywhere on the print medium. In order to print at odd angles, the initial angle of the IT device 200 may be captured. When the print offset angle is not zero, the position information should be rotated to affect a rotation of the image on the print medium.

Before the position information is conveyed to the print system, the positions are rotated about the initial or start position of the image. The result is a position and angle relative print.

$$X_r = X^* \text{Cos}\ \theta - Y^* \text{Sin}\ \theta \quad \text{Eq. 5}$$

$$Y_r = X^* \text{Sin}\ \theta + Y^* \text{Cos}\ \theta \quad \text{Eq. 6}$$

For convenience, the angle may be snapped to the 0, 90, 180 and 270 offsets. To do this, the angle may be forced to one of the 4 snap angles. The "snap" occurs when the angle is within a small range close to the 90 degree snap angles.

After the position and angle of the IT device 200 is computed by the position module 134, the information is passed to the print head 204, which may compute the position of every nozzle with respect to the image and fires the relevant nozzles.

Figure 10:
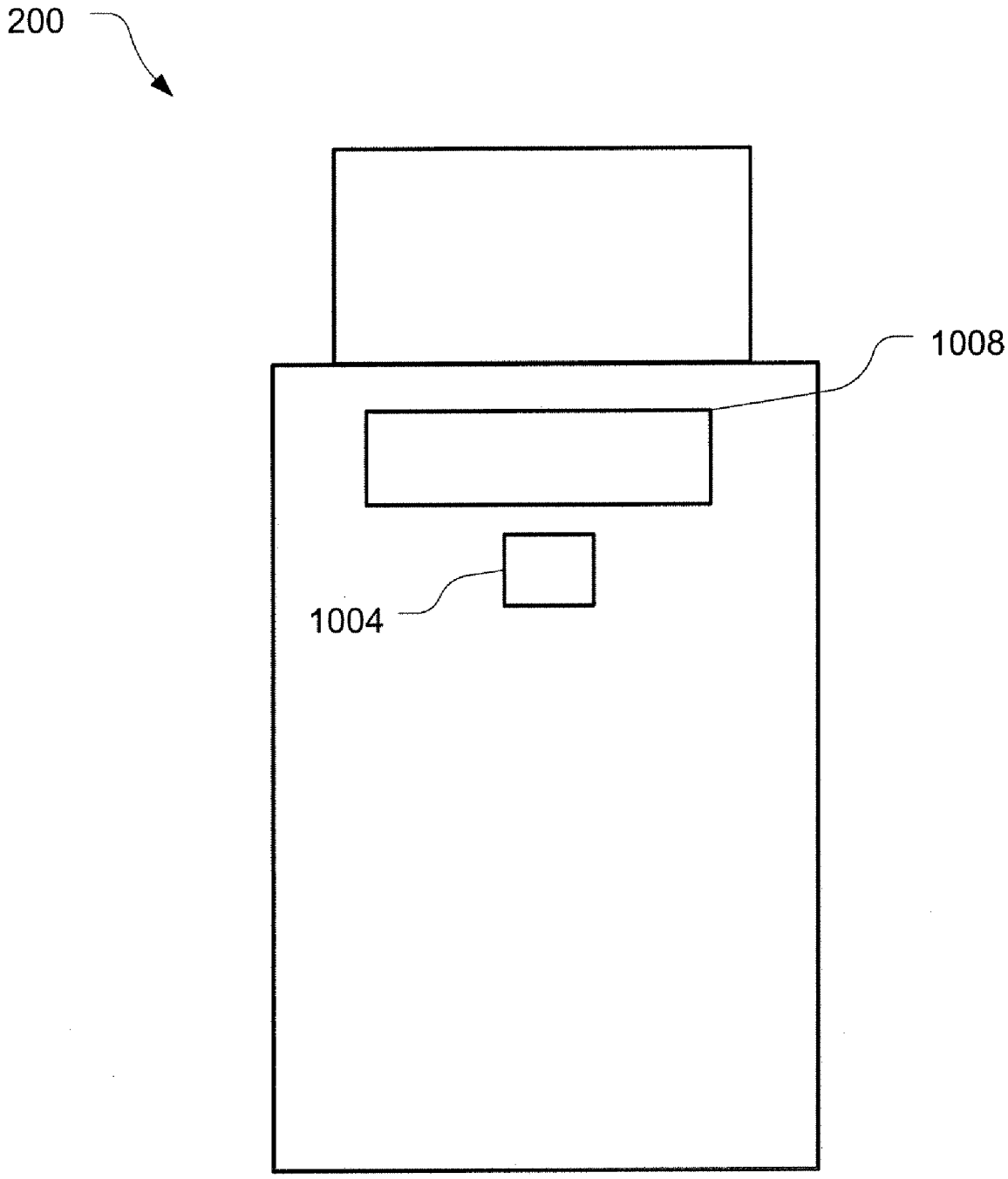
FIG. 10 is a top plan view of a handheld image translation device, in accordance with various embodiments of the present invention.

FIG. 10 is a top plan view of the IT device 200 in accordance with various embodiments of the present invention. The IT device 200 may have a variety of user input/outputs to provide the functionality enabled through use of the IT device 200. Some examples of input/outputs that may be used to provide some of the basic functions of the IT device 200 include, but are not limited to, an IT control input 1004 to initiate/resume a print and/or scan operation and a display 1008.

The display 1008, which may be a passive display, an interactive display, etc., may provide the user with a variety of information. The information may relate to the current operating status of the IT device 200 (e.g., printing, scanning, ready to print, ready to scan, receiving image data, transmitting image data, etc.), power of the battery, errors (e.g., positioning/printing/scanning error, etc.), instructions (e.g., "place IT device on medium prior to initiating IT operation," etc.). If the display 1008 is an interactive display it may provide a control interface in addition to, or as an alternative from, the IT control input 1004.

Figure 11:
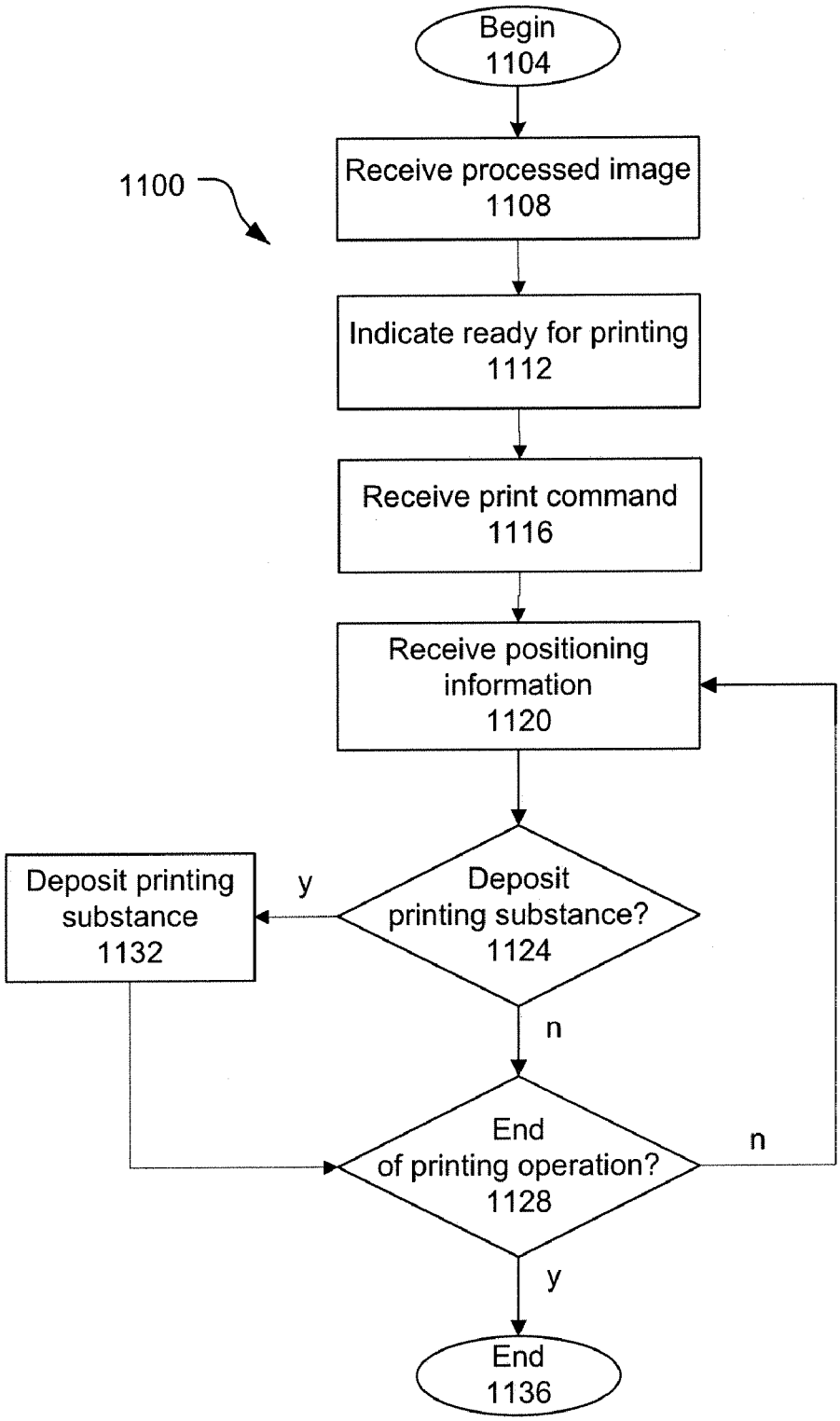
FIG. 11 is a flow diagram depicting a printing operation of a handheld image translation device, in accordance with various embodiments of the present invention.

FIG. 11 is a flow diagram 1100 depicting a printing operation of the IT device 200 in accordance with various embodiments of the present invention. The printing operation may begin at block 1104. The print module may receive a processed image from the image processing module at block 1108. Upon receipt of the processed image, the display 1008 may indicate that the IT device 200 is ready for printing at block 1112.

The print module may receive a print command generated from a user activating the IT control input 1004 at block 1116. The print module may then receive positioning information from the position module at block 1120. The print module may then determine whether to deposit printing substance at the given position at block 1124. The determination as to whether to deposit printing substance may be a function of the total drop volume for a given location and the amount of volume that has been previously deposited.

The print module may make a determination to deposit printing substance by reading a representation of the printed image in memory. If the printing module determines that printing substance is to be deposited, it may modify the image representation to account for the amount and location of deposited printing substance. The print module may use the modified representation to determine if additional deposition of printing substance is required. The print module may use the modified representation to alter the amount of printing substance deposited.

If it is determined that no additional printing substance is to be deposited at block 1124, the operation may advance to block 1128 to determine whether the end of the print operation has been reached. If it is determined that additional printing substance is to be deposited at block 1124, the print module may cause an appropriate amount of printing substance to be deposited at block 1132 by generating and transmitting control signals to the print head that cause the nozzles to drop the printing substance.

As can be seen, the position module's determination of the translation and rotation of the IT device 200 is done prior to the print module controlling the print head to deposit a printing substance. In order for the positioning information to remain relevant to the print determination, it may be desirable that the determination of the positioning information take place as soon as possible after the acquisition of the navigational measurements upon which it is based. Accordingly, the translation and rotation calculations may be done in real time based on data accumulated up to that point. The rotation calculations are not determined retroactively based on a comprehensive accumulation of translation and image data as is done in prior art scanning devices discussed above.

The determination of whether the end of the printing operation has been reached at block 1128 may be a function of the total printed volume versus the total anticipated print volume. In some embodiments the end of the printing operation may be reached even if the total printed volume is less than the total anticipated print volume. For example, an embodiment may consider the end of the printing operation to occur when the total printed volume is ninety-five percent of the total anticipated print volume. However, it may be that the distribution of the remaining volume is also considered in the end of print analysis. For example, if the five percent remaining volume is distributed over a relatively small area, the printing operation may not be considered to be completed.

In some embodiments, an end of print job may be established by a user manually cancelling the operation.

If, at block 1128, it is determined that the printing operation has been completed, the printing operation may conclude at block 1136.

If, at block 1128, it is determined that the printing operation has not been completed, the printing operation may loop back to block 1120.

Figure 12:
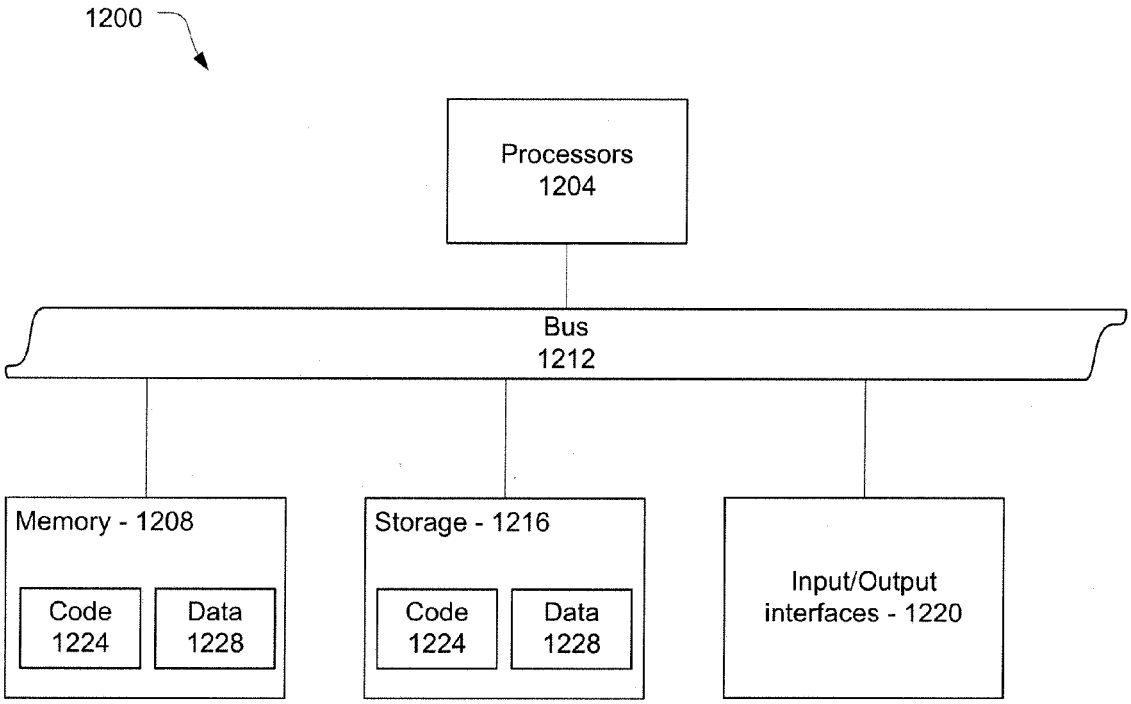
FIG. 12 illustrates a computing device capable of implementing a control block of a handheld image translation device, in accordance with various embodiments of the present invention.

FIG. 12 illustrates a computing device 1200 capable of implementing a control block, e.g., control block 108, in accordance with various embodiments. As illustrated, for the embodiments, computing device 1200 includes one or more processors 1204, memory 1208, and bus 1212, coupled to each other as shown. Additionally, computing device 1200 includes storage 1216, and one or more input/output interfaces 1220 coupled to each other, and the earlier described elements as shown. The components of the computing device 1200 may be designed to provide the printing and/or positioning functions of a control block of an IT device as described herein.

Memory 1208 and storage 1216 may include, in particular, temporal and persistent copies of code 1224 and data 1228, respectively. The code 1224 may include instructions that when accessed by the processors 1204 result in the computing device 1200 performing operations as described in conjunction with various modules of the control block in accordance with embodiments of this invention. The processing data 1228 may include data to be acted upon by the instructions of the code 1224. In particular, the accessing of the code 1224 and data 1228 by the processors 1204 may facilitate printing and/or positioning operations as described herein.

The processors 1204 may include one or more single-core processors, multiple-core processors, controllers, application-specific integrated circuits (ASICs), etc.

The memory 1208 may include random access memory (RAM), dynamic RAM (DRAM), static RAM (SRAM), synchronous DRAM (SDRAM), dual-data rate RAM (DDRRAM), etc.

The storage 1216 may include integrated and/or peripheral storage devices, such as, but not limited to, disks and associated drives (e.g., magnetic, optical), USB storage devices and associated ports, flash memory, read-only memory (ROM), non-volatile semiconductor devices, etc. Storage 1216 may be a storage resource physically part of the computing device 1200 or it may be accessible by, but not necessarily a part of, the computing device 1200. For example, the storage 1216 may be accessed by the computing device 1200 over a network.

The I/O interfaces 1220 may include interfaces designed to communicate with peripheral hardware, e.g., I/O components 112, navigation sensors 138, etc., and/or remote devices, e.g., image transfer device 120.

In various embodiments, computing device 1200 may have more or less elements and/or different architectures.

While embodiments of the present invention have been described with respect to handheld IT devices, those skilled in the art will understand that various aspects of embodiments may be applied to other types of handheld devices.

Although certain embodiments have been illustrated and described herein for purposes of description of preferred embodiments, it will be appreciated by those of ordinary skill in the art that a wide variety of alternate and/or equivalent embodiments or implementations calculated to achieve the same purposes may be substituted for the embodiments illustrated and described without departing from the scope of the present invention. Those with skill in the art will readily appreciate that embodiments in accordance with the present invention may be implemented in a very wide variety of ways. This application is intended to cover any adaptations or variations of the embodiments discussed herein. Therefore, it is manifestly intended that embodiments in accordance with the present invention be limited only by the claims and the equivalents thereof.

What is claimed is:

1. A method comprising:

initially moving a handheld device over a print medium, wherein the handheld device comprises a print head and a sensor;

while the handheld device is being initially moved over the print medium, having the handheld device deposit, in a tagging pattern, a tagging substance on the print medium;

further moving the handheld device over the print medium;

while further moving the handheld device over the print medium, sensing, by the sensor, at least part of the tagging pattern, wherein the sensor is disposed adjacent to a top area of the print head such that while the handheld device is being further moved over the print medium, the sensor moves over the tagging substance that was deposited on the print medium while the handheld device was being initially moved over the print medium;

determining, based upon the sensor sensing at least part of the tagging pattern as the sensor moves over the tagging substance, at least one of a position and a velocity of the handheld device; and while the handheld device is being further moved over the print medium, having the handheld device further deposit both (i) a printing substance, and (ii) the tagging substance on the print medium, wherein the printing substance is deposited on the print medium based on the at least one of the determined position and the determined velocity of the handheld device.

2. The method of claim 1, further comprising using an image representation to determine a level of deposition of the printing substance.

3. The method of claim 2, further comprising using an image representation that is modified as the printing substance is deposited.

4. The method of claim 1, further comprising determining a predictive position of the handheld device.

5. The method of claim 4, wherein the predictive position is determined using a two dimensional parametric curve function.

6. The method of claim 5, wherein the two dimensional parametric curve function is a Catmull-Rom Bicubic Spline function.

7. A handheld device comprising:

a print head configured to while the handheld device is initially being moved over a print medium, deposit on the print medium a tagging substance that indicates absolute position information for the handheld device, and while the handheld device is being further moved over the print medium, further deposit on the print medium (i) the tagging substance and (ii) a printing substance;

a print module configured to control the print head; and a position module comprising an image sensor and configured to determine at least one of a position and a velocity of the handheld device based upon the image sensor reading the tagging substance as the image sensor moves over the tagging substance, wherein the printing substance is deposited on the print medium based on at least one of the determined position and the velocity of the handheld device, wherein the image sensor is disposed adjacent to a top area of the print head such that while the handheld device is being further moved over the print medium, the image sensor moves over the tagging substance that was deposited on the print medium while the handheld device was being initially moved over the print medium.

8. The handheld device of claim 7, wherein the position module comprises two image sensors configured to read the tagging substance.

9. The handheld device of claim 8, wherein the two image sensors are infra-red CMOS sensors.

10. The handheld device of claim 7, wherein the handheld device is a printer.

11. The handheld device of claim 7, wherein the handheld device is an image translation device configured to print and to scan.

12. The handheld device of claim 7, wherein the position module is further configured to determine a predictive position of the handheld device.

13. The handheld device of claim 12, wherein the position module is configured to determine the predictive position of the handheld device using a two dimensional parametric curve function.

14. The handheld device of claim 13, wherein the two dimensional parametric curve function is a Catmull-Rom Bicubic Spline function.

15. A method comprising:

during a first sweep of a handheld device over a print medium, depositing, by the handheld device on the print medium, a tagging substance;

during a second sweep of the handheld device over the print medium, depositing, by a print head of the handheld device on the print medium, (i) more of the tagging substance and (ii) a printing substance; and during the second sweep of the handheld device, sensing, by a sensor of the handheld device, the tagging substance that was deposited during the first sweep, wherein the sensor is disposed adjacent to a top area of the print head such that during the second sweep, the sensor moves over the tagging substance that was deposited during the first sweep.

16. The method of claim 15, further comprising:

determining at least one of a position and a velocity of the handheld device based on sensing the tagging substance.

17. The method of claim 15, further comprising:

during a third sweep of the handheld device over the print medium, depositing, by the handheld device on the print medium, (i) even more of the tagging substance and (ii) more of the printing substance; and during the third sweep of the handheld device, sensing, by the handheld device, the more of the tagging substance that was deposited during the second sweep.

18. A handheld device comprising:

a print head configured to during a first sweep of the handheld device over a print medium, deposit a tagging substance, and during a second sweep of the handheld device over the print medium, deposit (i) more of the tagging substance and (ii) a printing substance;

a print module configured to control the print head; and an image sensor configured to, during the second sweep of the handheld device, sense the tagging substance that was deposited during the first sweep, wherein the image sensor is disposed adjacent to a top area of the print head such that during the second sweep, the image sensor moves over the tagging substance that was deposited during the first sweep.

* * * * *